United States Patent [19]

Zilges et al.

[11] 4,084,422

[45] Apr. 18, 1978

[54] EXTRUSION PRESS

[75] Inventors: Franz Josef Zilges, Monchen-Gladbach; Klaus Siegert, Berlin, both of Germany

[73] Assignee: Schloemann-Siemag Aktiengesellschaft, Dusseldorf, Germany

[21] Appl. No.: 570,368

[22] Filed: Apr. 22, 1975

[30] Foreign Application Priority Data

Apr. 24, 1974 Germany ..... 2419709

[51] Int. Cl.[2] ..... B21C 23/04; B21C 23/08

[52] U.S. Cl. ..... 72/253 R; 72/253 A; 72/265

[58] Field of Search ..... 72/253, 263, 264, 272, 72/274, 265, 273, 270

[56] References Cited

U.S. PATENT DOCUMENTS

| | | | |
|---|---|---|---|
| 572,872 | 12/1896 | Dick | 72/272 |
| 619,747 | 2/1899 | Holinger | 72/272 X |
| 887,718 | 5/1908 | Benjamin | 72/272 X |
| 2,713,418 | 7/1955 | Kent | 72/273 X |
| 3,012,664 | 12/1961 | Singleton | 72/263 |
| 3,653,247 | 4/1972 | Huertigen | 72/263 |
| 3,738,144 | 6/1973 | Doudet | 72/255 |
| 3,861,192 | 1/1975 | Suzuki | 72/273 X |
| 3,939,682 | 2/1976 | Nishihara et al. | 72/270 X |

FOREIGN PATENT DOCUMENTS

| | | | |
|---|---|---|---|
| 1,036,795 | 8/1958 | Germany | 72/263 |
| 1,113,197 | 8/1961 | Germany | 72/272 |
| 9,026 of | 1909 | United Kingdom | 72/265 |
| 370,274 | 4/1932 | United Kingdom | 72/272 |
| 432,685 | 7/1935 | United Kingdom | 72/273 |
| 613,057 | 11/1948 | United Kingdom | 72/253 |
| 752,930 | 7/1956 | United Kingdom | 72/264 |

*Primary Examiner*—Lowell A. Larson
*Assistant Examiner*—D. M. Gurley
*Attorney, Agent, or Firm*—Holman & Stern

[57] ABSTRACT

An extrusion press having a press stem which can be articulated to a limited extent at its base mounting in order to allow the stem to be exactly aligned with a billet containing bore; a centering sleeve provided at one end of the bore to guide the stem; and corresponding convex and concave surfaces at the base mounting which can slide over one another to permit the articulation.

16 Claims, 6 Drawing Figures

Fig. 1
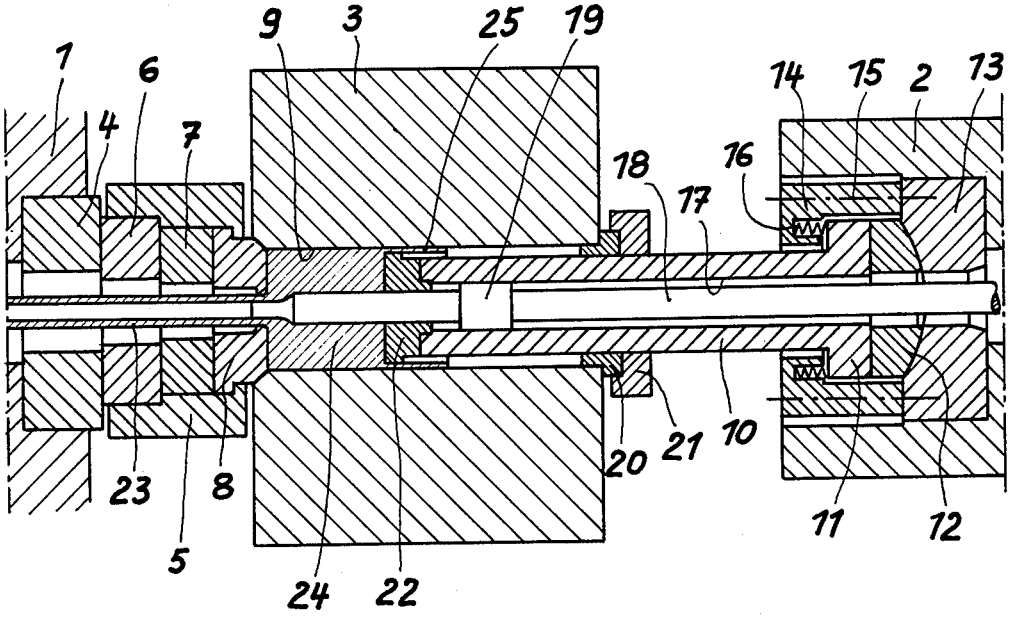
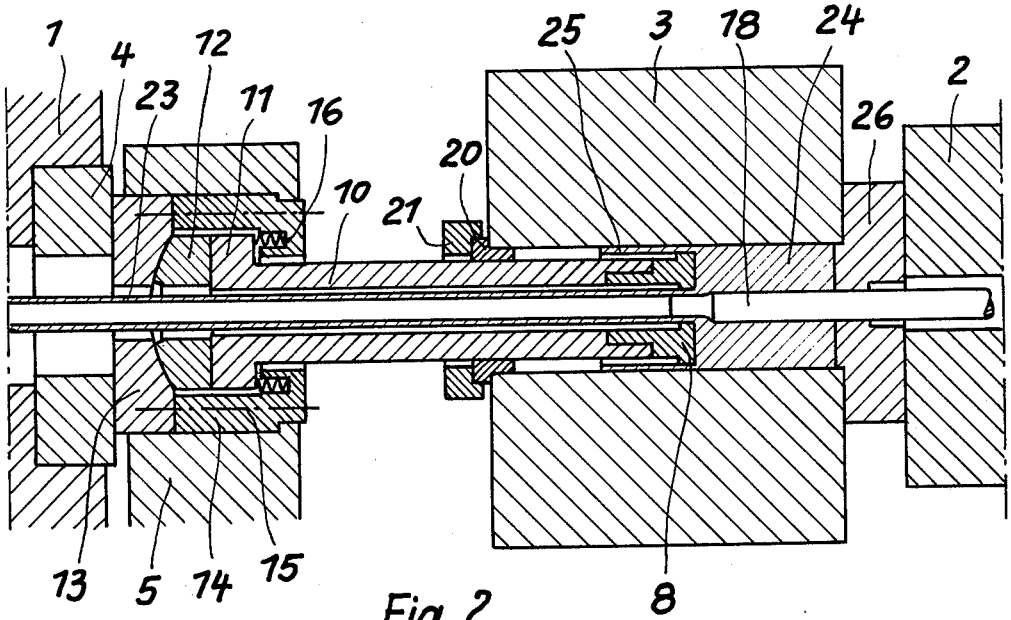
Fig. 2

EXTRUSION PRESS

FIELD OF THE INVENTION

The invention relates to an extrusion press, which may be a tube extrusion press, for direct and/or indirect extrusion of light metals, heavy metals and steel, by the extrusion process known as extrusion with shell.

BACKGROUND OF THE INVENTION

The press stem of both direct and indirect extrusion presses for light metals, heavy metals and steel is subjected to severe mechanical loading. The cross-section of the stem must be designed bearing in mind this loading and the strength of the material of which the stem is to be made.

When the stem is fixed rigidly at its foot, in conventional practice, it is not only subjected to thrust forces under working conditions resulting from the pressing force and its cross-sectional area, but it is also loaded by flexural stresses.

If these flexural stresses could be obviated, it would be possible, while maintaining the strength of the press stem material, to reduce its cross-sectional area. This can be of particular advantage in indirect extrusion presses. Alternatively, the strength of the press stem material could be reduced while maintaining its cross-sectional area. Furthermore, it would be possible, at a constant level of material strength and cross-sectional area, to increase the length of the plunger, which is also particularly desirable in indirect extrusion presses.

Both with direct and indirect extrusion presses, the requirement arises especially with the "extrusion with shell" and "tube extrusion around a mandrel" processes and also during the entering of the hole, that the press stem should be accurately centered, the tools being in corresponding alignment. Thus, for example, in the case of direct or indirect extrusion presses with formation of a shell, the billet should be subjected to pressure in such a way that the outer zones of the billet will adhere to the wall of the billet container. A shell with uniform wall thickness over its length and periphery can only be formed when the pressure disc (at the end of the stem) is exactly concentric in the bore of the billet container in the case of direct extrusion presses, or that the die complies with this condition in the case of indirect extrusion presses. Only when the pressed shell is of adequate and uniform wall thickness is it possible to avoid metallic oxides and impurities on the surface of the billet from being drawn into the extruded product.

With direct and indirect extrusion presses for tubes around a mandrel, especially with "tube extrusion with shell," it is essential for the attainment of close tube tolerances, that the mandrel should be exactly concentric with the billet container on the one hand and with the die on the other.

With direct tube extrusion presses, the mandrel is guided within the press stem. Consequently, concentrically locating the stem during tube extrusion also ensures accurate guiding of the mandrel.

With indirect tube extrusion processes, the mandrel is guided in a bore of an obturating member centrally mounted in the billet container. The die in this case is mounted in the end of the stem. In this case also, the stem must be able to move exactly concentrically in the bore of the billet container.

SUMMARY AND OBJECTS OF THE INVENTION

According to the invention, there is provided an extrusion press for direct or indirect extrusion, wherein the press stem is articulately mounted either in the moving cross-head in the case of direct extrusion, or in the counter platen, in the case of indirect extrusion, and means are provided for concentrically guiding the stem along the bore of the billet container.

Due to the central guiding along or in the billet container, and the flexible mounting of the press stem at its clamping point, it is possible to achieve a uniform wall thickness of the resulting shell during extrusion with shell, and to produce tubes of correspondingly close dimensional tolerances. Moreover, the stem is no longer subjected to flexural stresses, since by virtue of its mode of mounting it is able to accurately follow the center line.

According to a further feature of the invention, the foot or base of the stem bears against a pressure plate the rear of which is of curved or part-spherical in shape, and which is tiltably mounted in a mating concave bearing surface. The curved surface of the pressure plate of the stem is advantageously urged against the support surface by means of mechanical, hydraulic or pneumatic spring members mounted between the retaining ring and the annular surface of the foot of the stem. Helical compression springs are preferably used as the mechanical spring members.

According to a further feature of the invention, the angle of tilt of the articulately mounted press stem is adjustably controlled by the retaining ring.

A centering sleeve, which may be chamfered to facilitate insertion, is inserted in or on the bore of the billet container for the purpose of centering the stem. According to a further development the centering sleeve may comprise two semi-circular sleeve halves.

The centering sleeve may also advantageously be adapted to be urged against the billet container or its bore by spring members mounted on the stem.

According to yet a further feature of the invention, the centering device for the stem mounted on the billet container includes at least one slipper or shoe the contour of which is adapted to that of the stem and which is itself mounted on a holder. The holder for the slipper is advantageously hydraulically, pneumatically or mechanically, radially adjustable within guides mounted on the billet container, the range of adjustment being determined by adjustable stops.

For the purpose of centering the plunger, three slippers with their holders mutually angularly spaced by 120° are advantageously provided on the billet holder and can be automatically adjusted during the extrusion cycle.

The invention will now be further described, by way of example, with reference to the accompanying drawings in which:

DESCRIPTION OF THE FIGURES OF THE DRAWING

FIG. 1 is a sectional representation of a metal extrusion press for the direct extrusion of tubes, FIG. 2 is a sectional representation of a metal extrusion press for the indirect extrusion of tubes.

DESCRIPTION OF PREFERRED EMBODIMENTS

Figure 3:
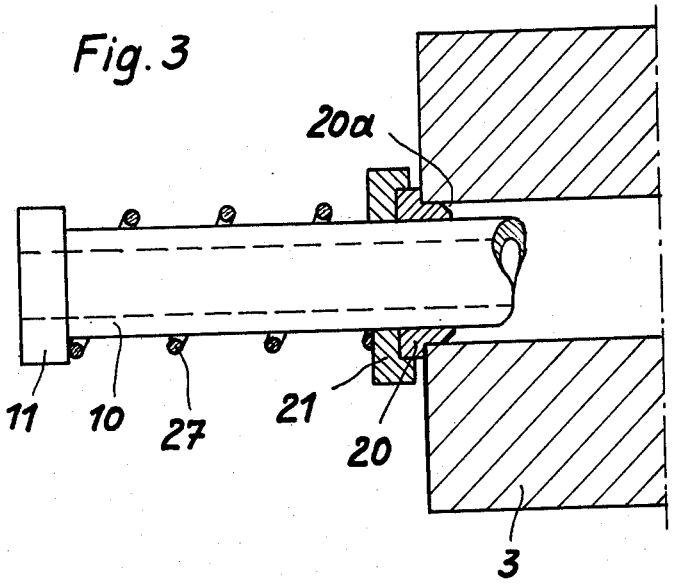
FIG. 3 shows a press stem, the centering sleeve guide means of which is spring-urged against the billet container.

FIG. 1 shows a metal extrusion press for extruding tubes by the direct method, having a counter platen 1, a moving or displaceable cross-head 2 and a billet container 3 positioned therebetween along the extrusion axis. A pressure plate 4 is provided in the counter platen 1 along the extrusion axis, against which thrust blocks 6 and 7, mounted in a tool holder 5 are in bearing contact. A die 8, which is centered on the bore 9 on the left-hand side of the billet container 3, lies adjacent the thrust block 7.

A press stem 10, the flanged foot 11 of which bears against a pressure plate 12, is provided in the ram or cross head 2. The pressure plate 12 is domed (curved) on the side remote from the stem 10 and bears against a support or thrust plate 13, the mating surface of which has a corresponding concavity and which in turn is also mounted in the cross-head 2. It would alternatively be possible for the pressure plate 12 to be concave, and the support or thrust plate 13 to be convex. A retaining ring 14, which grips the foot 11 of the stem 10, is fastened to the support plate 13 by means of bolts 15. Helical compression springs 16 are provided between the foot 11 of the stem 10 and the retaining ring, which force the foot of the stem 10 against the pressure plate 12, the pressure thereby being transmitted through the domed bearing surfaces to the support or thrust plate 13. This arrangement ensures that the plunger (stem) 10 is mounted so as to hinge (pivot) within a prescribed angle, for example, $\pm 3°$.

The press stem is of hollow construction. A mandrel 18 is guided in the bore 17 of the stem by means of a centering ring 19. The tip of the mandrel 18, which is stationary during the extrusion cycle, projects into the opening in the die 8. The stem 10 is guided in or along the billet container 3 by means of a centering sleeve 20, which is mounted in a ring 21. A pressure disc 22, the external diameter of which is less than that of the bore 9 of the billet container 3, is concentrically mounted at the head of the stem 10.

A billet 24, which is to be extruded in the form of a tube 23, is positioned between the head of the stem or the pressure disc 22 and the die 8. In the course of extrusion of the hollow billet 24 around the tip of the mandrel 18 and through the aperture of the die 8 so as to form the tube 23, a shell 25 is formed in the annular space between the pressure disc 22 and the bore 9 of the billet holder 3. Owing to the hinged nature of the mounting of the stem foot 11 and the centering of the stem itself in the bore 9 of the billet container 3, the shell 25 will be of uniform wall thickness.

FIG. 2 illustrates the indirect extrusion process. The support or thrust plate 13, which is centered in the tool holder 5, bears against the pressure plate 4 of the back rest 1. One side of the pressure plate 12, which is domed, bears against the concave front surface of the thrust support plate 13, whilst the foot 11 of the stem 10 is in contact with the other side. The retaining ring 14 which is fastened by bolts 15 to the thrust plate 13, forces the foot 11 of the stem 10 against the pressure plate 12 by means of helical springs 16.

The hollow stem 10, which is, as before, centrally mounted in the centering sleeve 20 carried in a ring 21 on the billet holder 3, is stationary during the indirect extrusion process. The die 8 is concentrically mounted during this process on the head of the stem 10.

In order to form a shell 25, the diameter of the die 8, which is in this case centered in the bore 9 by means of the stem, is less than the diameter of said bore.

The right-hand end of the bore 9 of the billet holder 3 is closed by a closure member 26. The closure member 26 links the billet container 3 with the moving cross-head 2. The mandrel 18, the tip of which is inserted in the die orifice during the indirect extrusion process, is centrally mounted in the closure member 26.

The hollow billet 24, positioned in the bore 9 of the billet container 3, is extruded through the orifice of the stationary die 8, in the form of a tube 23, into the hollow stationary press stem by means of the mandrel 18, as the container moves to the left with the moving cross-head 2. In this case, the extruded shell 25 forms, as shown in FIG. 2, in the bore 9 to the left of the die 8.

The centering sleeve 20 (FIG. 3) can be forced into the end of the bore 9 of the billet holder 3 by means of a helical compression spring 27 mounted between said centering sleeve and the foot 11 of the stem 10 around the shaft of the stem. The sleeve has a chamfered portion **20*a* to facilitate its insertion into the bore 9**.

The centering sleeve 20 may also take the form of two half-cups (not shown), which together have the same shape as the original centering sleeve. They are inserted manually into the bore at the commencement of the extrusion cycle. The compression spring 27 is not used when the centering sleeve is in the form of two half-cups. Alternatively, the sleeve may take the form of three cups (not shown), each providing one third of the circumference and spaced 120° apart around the bore. These cups may be automatically adjustable during the extrusion cycle.

Figure 4:
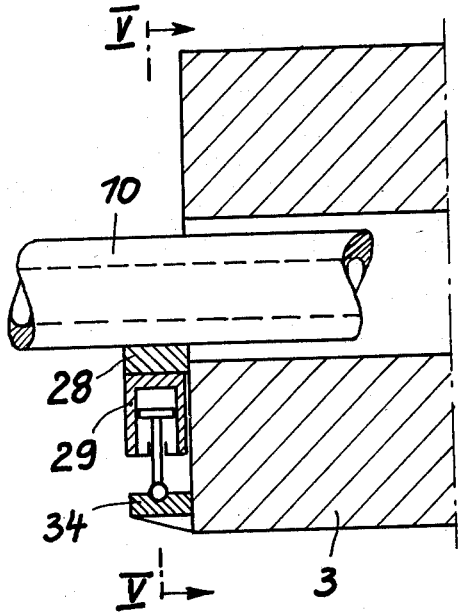
FIG. 4 shows the guide means of a press stem in the billet container by means of a slipper mounted in a slipper holder, corresponding to the section of IV—IV of FIG. 5.
Figure 5:
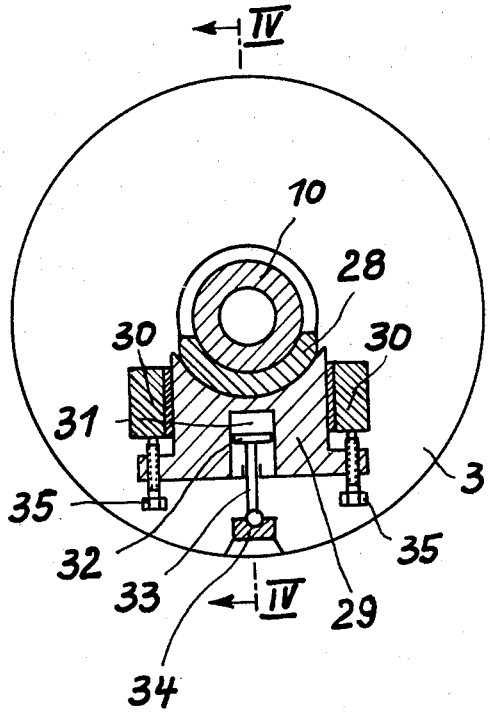
FIG. 5 is a section along the line V—V of FIG. 4.
Figure 6:
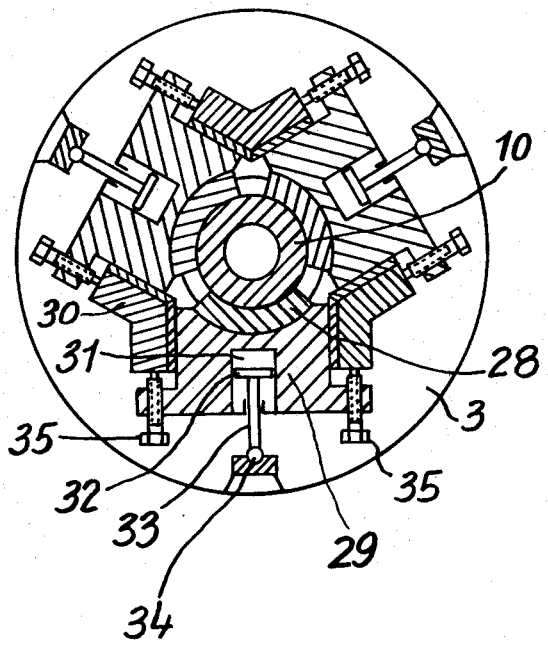
FIG. 6 is a cross section illustrating another embodiment of the invention.

As shown in FIGS. 4, 5 and 6, the stem 10 is guided by at least one slipper 28, which is mounted in the billet holder 3 in a slipper holder 29 and which conforms to the outer contour of the stem 10. The slipper holder 29 is slidable radially in guides 30 fixed to the billet container 3. The positioning of the slipper 28 against the stem 10 is carried out hydraulically or pneumatically by means of a piston cylinder unit. A cylinder 31 is provided in the slipper holder 29, and a piston 32 slides within the cylinder. The piston rod 33 bears against an abutment 34 fixed to the billet holder 3. Adjustable stops 35 limiting the stroke ensure the central positioning of the stem 10.

We claim:

1. An extrusion press for direct extrusion with shell, comprising a billet container, a billet containing bore in the billet container, a displaceable cross-head movable towards and away from the billet container, a press stem mounted in the displaceable cross-head and movable along the billet containing bore spaced from the walls thereof when the cross-head is displaced towards and away from the bore, means mounted on the billet container and separate and distinct therefrom for centering the press stem as it moves along said bore, and means articulately mounting said press stem for relative movement to and in the displaceable cross-head.

2. An extrusion press as claimed in claim 1, and further comprising a pressure plate arranged between the press stem and the cross-head and having a convex surface, and wherein the cross-head includes a thrust plate with a concave surface for mating with said convex surface to form said articulate mounting means.

3. An extrusion press as claimed in claim 2, further including a retaining ring on the cross-head, a flange on the press stem and biasing means arranged between the retaining ring and the flange to bias said convex and concave surfaces into contact with each other.

4. An extrusion press as claimed in claim 1, wherein said means for centering the press stem comprise a centering sleeve mounted in the bore of the billet container, said sleeve being provided with a chamfer for the purpose of inserting it in the bore.

5. An extrusion press as claimed in claim 4 and including spring means for urging the centering sleeve against the billet container.

6. An extrusion press as claimed in claim 1, wherein the means for centering the press stem comprises a slipper conforming to the shape of the press stem, and a slipper holder for locating the said slipper.

7. An extrusion press as claimed in claim 6, wherein the slipper holder is radially adjustable relative to said billet containing bore.

8. An extrusion press as claimed in claim 6, comprising three slippers located in slipper holders mutually angularly spaced by 120°.

9. An extrusion press for indirect extrusion with shell, comprising a counter platen, a billet container movable towards and away from the counter platen, a billet containing bore in the billet container, a press stem mounted at one end in the counter platen and movable along the billet containing bore spaced from the walls thereof, means mounted on the billet container and separate and distinct therefrom for centering the press stem as it moves along the said bore, and means articulately mounting said press stem in the counter platen.

10. An extrusion press as claimed in claim 9, and further comprising a pressure plate arranged between the stem and the counter platen and having a convex surface, and wherein the counter platen includes a thrust plate with a concave surface for mating with said convex surface to form said articulately mounting means.

11. An extrusion press as claimed in claim 10, further including a retaining ring on the counter platen, a flange on the press stem and biasing means arranged between the retaining ring and the flange to bias said convex and concave surfaces into contact with each other.

12. An extrusion press as claimed in claim 9, wherein said means for centering the press stem comprises a centering sleeve mounted in the bore of the billet container, said sleeve being provided with a chamfer for the purpose of inserting it in the bore.

13. An extrusion press as claimed in claim 12 and including spring means for urging the centering sleeve against the billet holder.

14. An extrusion press as claimed in claim 9, wherein the means for centering the press stem comprise a slipper conforming to the shape of the press stem, and a slipper holder for locating the said slipper.

15. An extrusion press as claimed in claim 14, wherein the slipper holder is radially adjustable relative to said billet containing bore.

16. An extrusion press as claimed in claim 14, comprising three slippers located in slipper holders mutually angularly spaced by 120°.

* * * * *